US006640987B2

(12) United States Patent
Vassallo

(10) Patent No.: US 6,640,987 B2
(45) Date of Patent: Nov. 4, 2003

(54) CHILD RESISTANT CLOSURE AND CONTAINER HAVING AXIALLY OFFSET LOCKING TEETH

(75) Inventor: John A. Vassallo, Lititz, PA (US)

(73) Assignee: Kerr Group, Inc., Lancaster, PA (US)

( * ) Notice: Subject to any disclaimer, the term of this patent is extended or adjusted under 35 U.S.C. 154(b) by 0 days.

(21) Appl. No.: 09/725,082

(22) Filed: Nov. 29, 2000

(65) Prior Publication Data

US 2002/0162817 A1 Nov. 7, 2002

Related U.S. Application Data

(60) Provisional application No. 60/168,018, filed on Nov. 30, 1999.

(51) Int. Cl.[7] ..... B65D 55/02

(52) U.S. Cl. ..... 215/216; 215/216; 215/217; 215/330; 215/334; 215/218; 220/281

(58) Field of Search ..... 215/216, 217, 215/218, 219, 220, 221, 334, 330, 331, 43–45, 321, 209; 220/281

(56) References Cited

U.S. PATENT DOCUMENTS

| | | | | | |
|---|---|---|---|---|---|
| 3,297,185 | A | * | 1/1967 | Plymale | 215/330 |
| 3,399,796 | A | * | 9/1968 | Steiner | 215/216 |
| 3,608,763 | A | * | 9/1971 | Smith et al. | 215/217 |
| 4,084,717 | A | * | 4/1978 | King | 215/217 |
| 4,117,945 | A | * | 10/1978 | Mumford | 215/216 |
| 4,138,028 | A | * | 2/1979 | Price et al. | 215/216 |
| 4,213,534 | A | * | 7/1980 | Montgomery | |
| 4,270,664 | A | * | 6/1981 | Buono | 215/216 |
| 4,289,248 | A | * | 9/1981 | Lynn | 215/330 |
| 4,345,690 | A | | 8/1982 | Hopley | 215/216 |
| 4,351,442 | A | | 9/1982 | Summers | 215/216 |
| 4,413,743 | A | | 11/1983 | Summers | 215/216 |
| 4,436,211 | A | | 3/1984 | Gach | 215/216 |
| 4,456,136 | A | * | 6/1984 | Palsson | 215/216 |
| 4,548,329 | A | | 10/1985 | Curry | 215/216 |
| 4,567,991 | A | | 2/1986 | Anderson | 215/216 |
| 4,579,239 | A | | 4/1986 | Hart | 215/224 |
| 4,588,097 | A | | 5/1986 | Hauser | 215/216 |
| 5,078,288 | A | | 1/1992 | Fuchs | 215/209 |
| 5,143,234 | A | * | 9/1992 | Lohrman et al. | 215/331 X |
| 5,238,130 | A | * | 8/1993 | Marques et al. | 215/216 |
| 5,464,110 | A | | 11/1995 | Heyworth | 215/223 |
| 5,638,969 | A | | 6/1997 | King | 215/216 |
| 5,687,863 | A | | 11/1997 | Kusz | 215/216 |
| 5,749,496 | A | | 5/1998 | DeJonge et al. | 222/153.14 |
| 5,836,465 | A | | 11/1998 | King | 215/216 |
| 5,884,787 | A | | 3/1999 | Quintard et al. | 215/216 |
| 5,915,576 | A | * | 6/1999 | Robinson | 215/334 X |
| 6,112,921 | A | * | 9/2000 | Robinson | 215/216 |

* cited by examiner

*Primary Examiner*—Robin A. Hylton
(74) *Attorney, Agent, or Firm*—Kenyon & Kenyon

(57) ABSTRACT

A child resistant closure and container according to the present invention include a container having a neck with an engagement mechanism such as an external thread. The container also includes at least one container lug, and preferably a pair of lugs disposed on opposite sides of the container. The child resistant closure includes a top wall with at least one skirt depending from the top wall. Locking teeth are disposed in a set on the inner surface of the skirt, with the locking teeth being arranged circumferentially around a portion of the inner surface, and the locking teeth being arranged axially offset from one another. The closure may also include a thinned-out region in the vicinity of the locking teeth to facilitate deformation of the closure.

17 Claims, 6 Drawing Sheets

CHILD RESISTANT CLOSURE AND CONTAINER HAVING AXIALLY OFFSET LOCKING TEETH

RELATED APPLICATION

This application claims the benefit of U.S. Provisional Application No. 60/168,018, filed Nov. 30, 1999.

FIELD OF THE INVENTION

The present invention relates to child resistant closures and containers, and in particular to child resistant closures and containers requiring deformation of the closure to achieve opening.

BACKGROUND INFORMATION

Many closures and containers include child resistant features to minimize the opportunity for a children to obtain access to contents of the container. One type of child resistant closure and container, commonly referred to as a squeeze-and-turn closure, includes one or more locking teeth disposed on the closure that cooperate with one or more lugs on the container. The locking teeth engage the container lugs to prevent removal of the closure from the container without squeezing the closure to deform it, thereby disengaging the teeth and lugs and allowing rotation of the closure. Such a closure is described, for example, in U.S. Pat. No. 4,213,534 to Montgomery.

One problem with child resistant closures and containers is that some persons, for example elderly persons or those with debilitating conditions such as arthritis, may have difficulty removing the closure from the container. For example, some squeeze-and-turn closures may prove difficult to deform sufficiently to achieve clearance between the closure teeth and the container lugs. In addition, the arrangement of the teeth and lugs may cause these elements to engage unnecessarily or to fail to engage. These problems may be exacerbated, for example, in closures and containers that require very small tolerances in manufacturing.

SUMMARY OF THE INVENTION

A child resistant closure and container combination according to the present invention includes a container having a neck with an engagement mechanism such as an external thread. The container also includes at least one container lug. The child resistant closure includes a top wall with a skirt depending from the top wall, where the skirt is preferably provided with a complimentary engagement mechanism such as an internal thread. A plurality of locking teeth are disposed on the inner surface of the skirt, with the plurality of locking teeth being arranged circumferentially around a portion of the inner surface, and the locking teeth being arranged axially offset from one another. The closure may also include a thinned-out region in the vicinity of the locking teeth to facilitate deformation of the closure.

DETAILED DESCRIPTION OF THE PREFERRED EMBODIMENTS

Figure 1B:
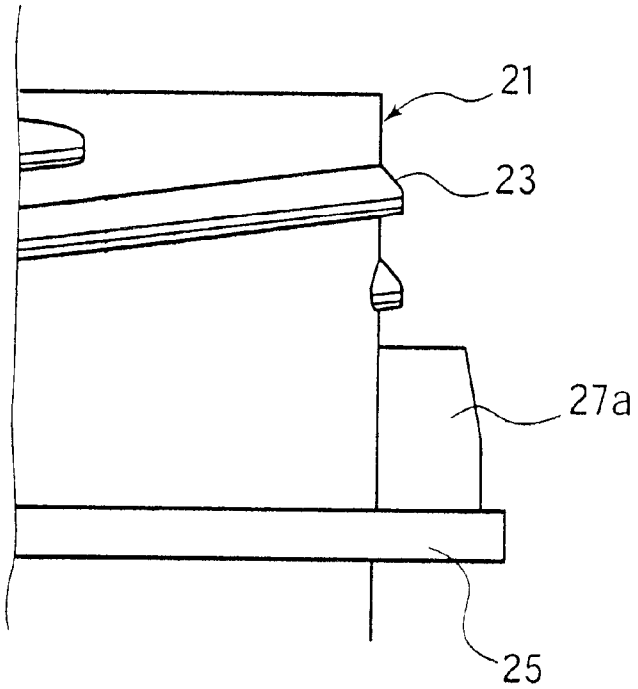
FIG. 1B is a side view of an exemplary embodiment of a container according to the present invention.
Figure 1A:
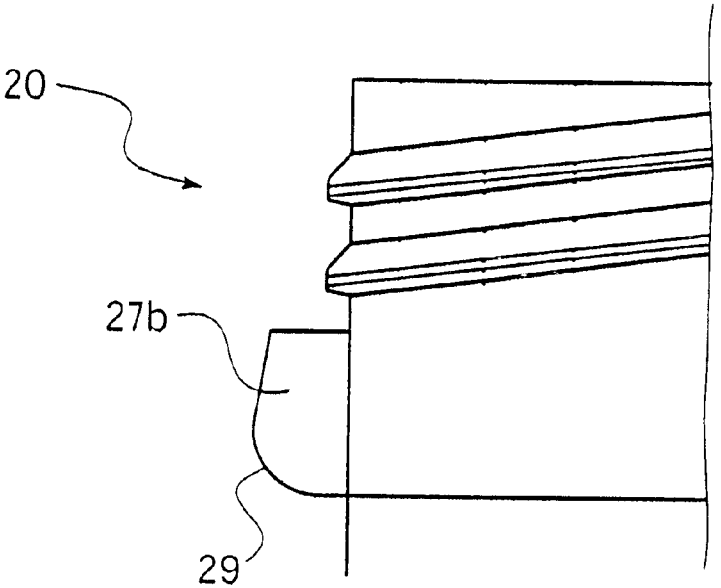
FIG. 1A is a side view of an exemplary embodiment of a container according to the present invention.
Figure 2:
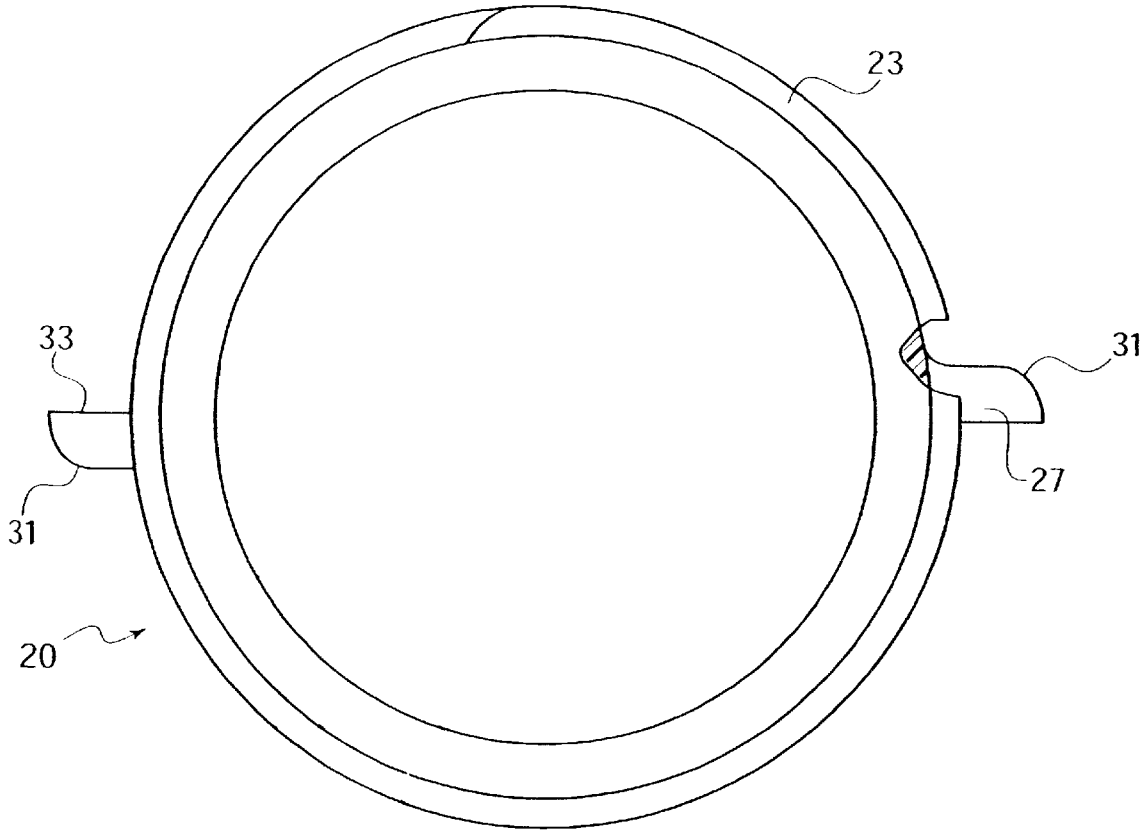
FIG. 2 is a top view of an exemplary embodiment of a container according to the present invention.

FIGS. 1A, 1B and 2 illustrate an exemplary container 20 according to the present invention. In general, container 20 may be of any suitable shape useful for holding desired contents, such as tablets, powders, liquids, etc. Container 20 may also be formed using any suitable manufacturing technique, for example injection or compression molding, blow molding or injection stretch blow molding. Likewise container 20 may be formed from any suitable plastic, for example polyethylene terephthalate (commonly referred to as "PET"), high-density polyethylene, or a multilayer material, including for example those materials above and, for example, nylon or polypropylene.

As illustrated in FIGS. 1A, 1B and 2 includes a neck 21 which defines an opening of container 20. Neck 21 includes a container retention formation such as an external thread 23. As discussed in more detail below, external thread 23 cooperates with a corresponding formation on a closure to retain the closure on container 20. While external thread 23 is a preferred container retention formation, any suitable type of retention formation may be provided. The term "external thread" is understood to include other suitable retention formations, including lugs or similar members. The term external thread is also understood to include arrangements having multiple thread starts.

Container 20 includes at least on container lug 27, preferably disposed below external thread 23. FIGS. 1A and 1B illustrate two container lugs 27*a* and 27*b*. Container 20 may also include a shoulder 25, if desired, as illustrated in FIG. 1B. If shoulder 25 is present, container lug 27 may be connected to shoulder 25, neck 21, or both, as illustrated in FIG. 1B by container lug 27*a*. If shoulder 25 is not present, or if container lug 27 otherwise does not contact shoulder 25, then container lug 27 may be connected to neck 21. This arrangement is illustrated in FIG. 1A by container lug 27*b*. Preferably, if container lug 27 is not supported by or contacting shoulder 25, then a bottom edge 29 of container lug 27 is preferably rounder or curved as illustrated by container lug 27*b*.

Container 20 preferably includes at least two container lugs 27 as illustrated in FIGS. 1A, 1B and 2. Preferably, container lugs 27 are disposed on opposite sides of neck 21, approximately 180° apart, as shown in FIG. 2. Although container lugs 27 may be formed in any suitable shape, container lugs 27 preferably include a ramped or curved leading edge 31, as well as a locking surface 33. Container lugs 27 may be formed so that locking surface 33 extends radially outwardly from neck 21, preferably perpendicularly to neck 21, as shown in FIG. 2. Alternatively, container lugs 27 may be back-angled, so that locking surface 33 forms an acute angle with neck 21. Container lugs 27 could also be arranged in a forward-angled configuration, if desired. Locking surface 33 preferably is a planar surface, although its shape can be any suitable shape which cooperates with locking the locking teeth of the closure to retain the closure and container 20 in a child-resistant configuration.

Figure 3:
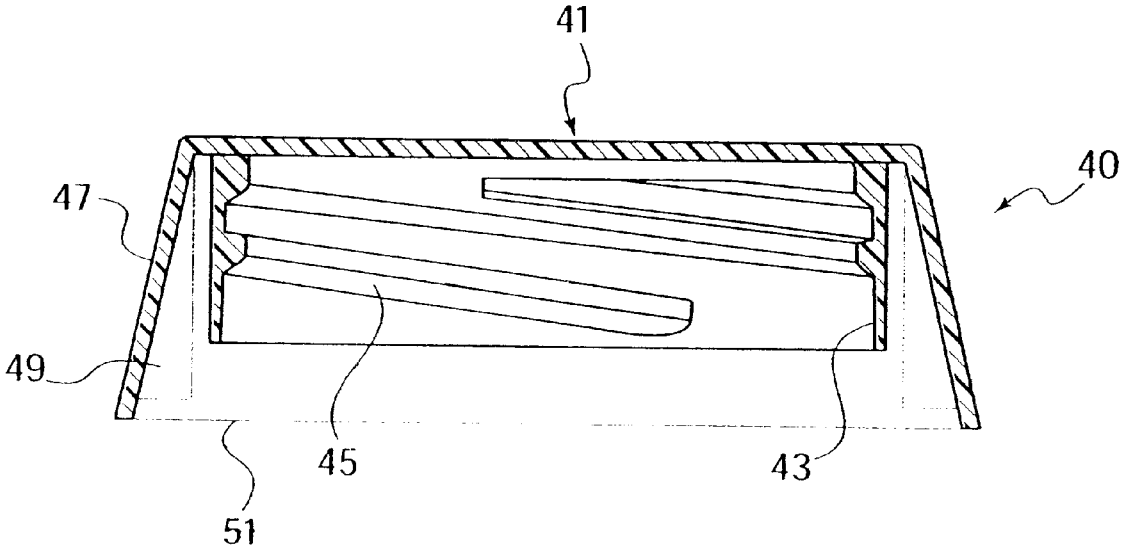
FIG. 3 is a cross-sectional side view of an exemplary embodiment of a closure according to the present invention.
Figure 4:
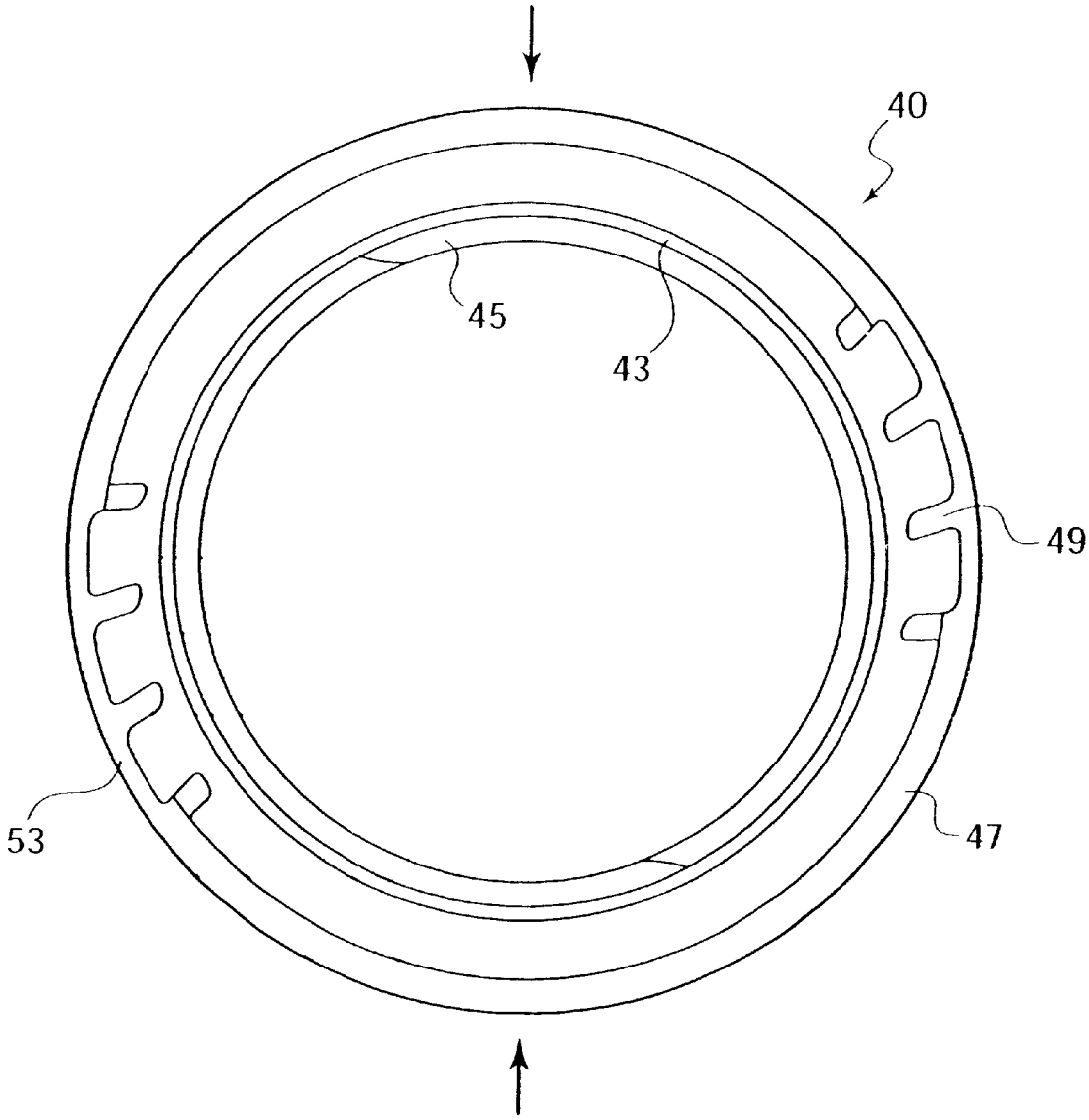
FIG. 4 is a bottom view of the closure of FIG. 3.
Figure 5:
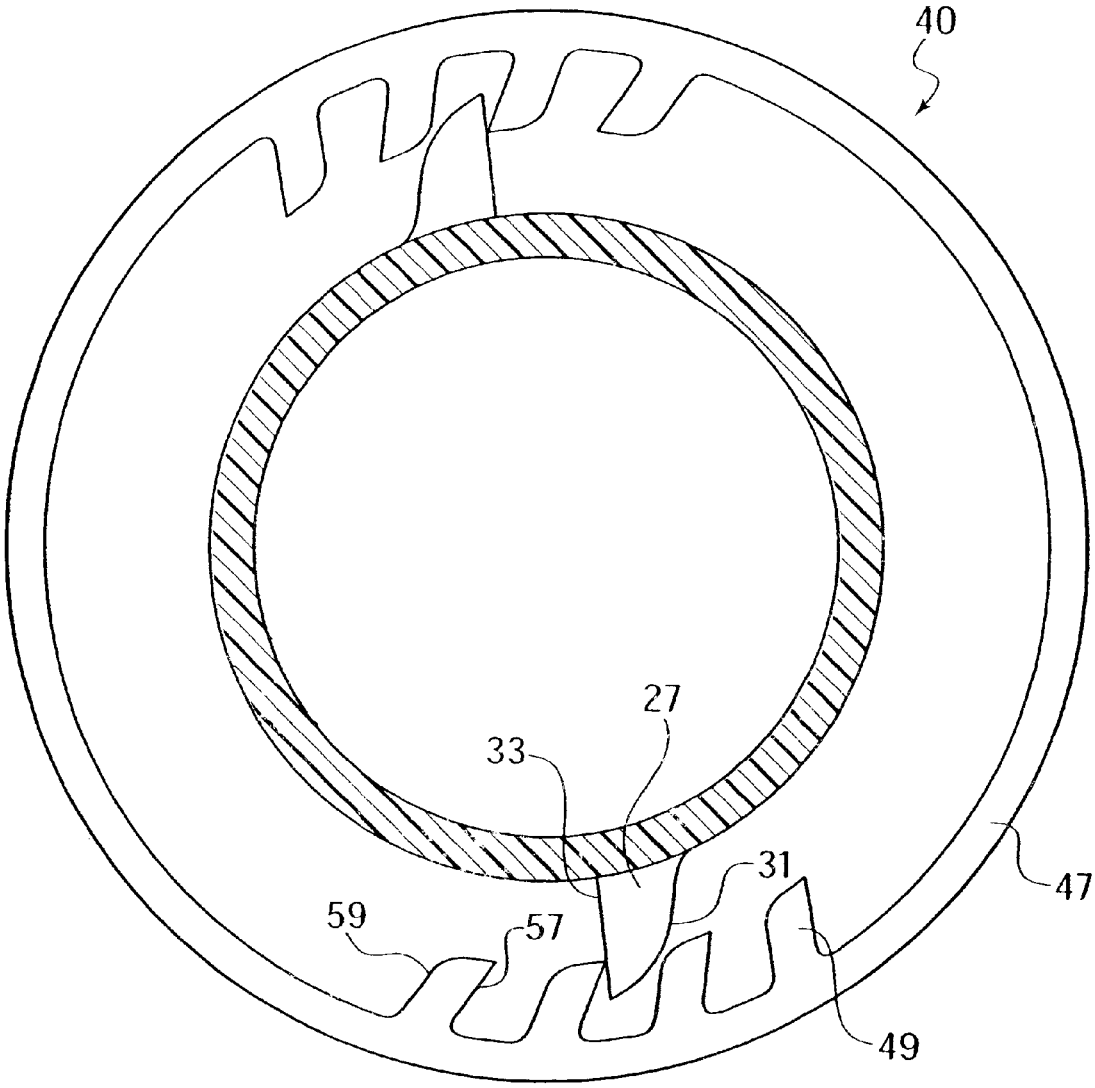
FIG. 5 is a top view cross-sectional view of an exemplary container and closure according to the present invention.
Figure 6:
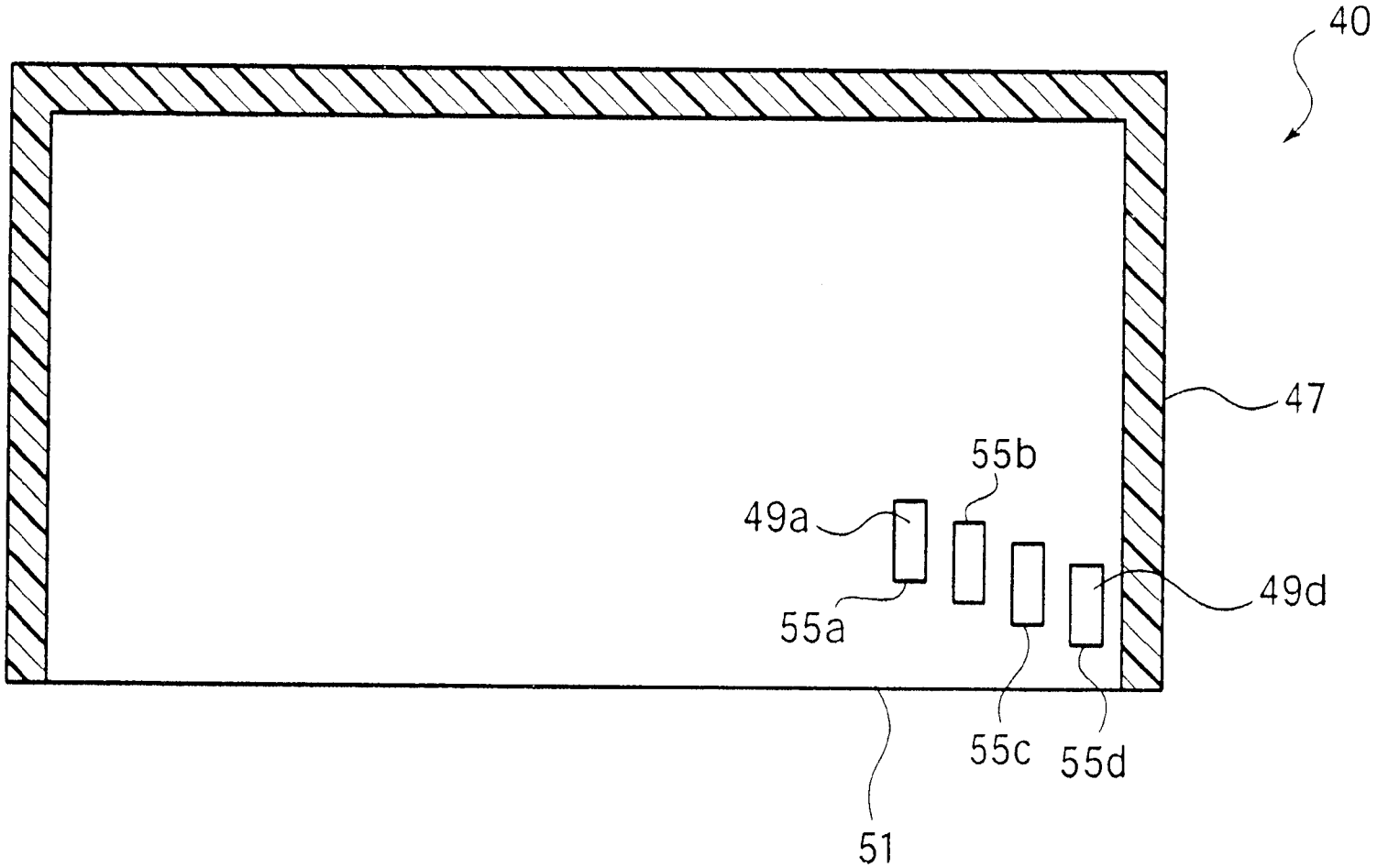
FIG. 6 is a schematic side cross-sectional view of a further exemplary closure according to the present invention.

FIGS. 3 through 5 illustrate an exemplary embodiment of a closure 40 according to the present invention. In general, closure 40 may be formed using any suitable manufacturing process, for example injection or compression molding. While any suitable materials may be used, preferable materials include plastics such as polypropylene or high-density polyethylene.

As illustrated in FIG. 3, closure 40 includes a top wall 41 and at least one skirt depending from top wall 41. The skirt may contain a closure retention formation, such as a thread or lug, and a plurality of locking teeth. In the exemplary embodiment illustrated in FIG. 3, closure 40 includes an inner skirt 43 and an outer skirt 47. Top wall 41 may be, for example, circular in shape, with inner skirt 43 being preferably annular and outer skirt 47 being preferably frusto-conical. Inner skirt 43 includes a closure retention formation on an inner surface, such as internal thread 45. Internal thread 45 may cooperate with external thread 23 of container 20 to retain closure 40 on container 20. As with external thread 23, it is understood that the term "internal thread" includes other suitable retention formations such as lugs or other engaging features.

As illustrated in FIGS. 3 and 4, outer skirt 47 includes a plurality of locking teeth 49 disposed on the inner surface of outer skirt 47. As best seen in FIG. 4, the plurality of locking teeth 49 are preferably grouped in two sets, although a single set of locking teeth 49 could be provided. The locking teeth 49 within each set are spaced circumferentially around a portion of outer skirt 47, with the two sets of locking teeth 49 preferably disposed on opposite sides of outer skirt 47, approximately 180° from one another. In the illustrated embodiment, closure 40 includes a total of eight locking teeth 49, grouped into two sets of four teeth. However, it is understood that any suitable number of locking teeth may be provided in one or more sets. In addition, locking teeth 49 are preferably back-angled, as illustrated in FIG. 4, but other suitable arrangements are within the scope of the present invention.

As illustrated in FIG. 5, when closure 40 is applied to container 20, locking teeth 49 engage container lugs 27 to prevent rotation of closure 40 in an opening direction. As shown in FIG. 5, locking teeth 49 preferably include a lock surface 57 and a ramped surface 59, where the term "ramped" includes curved or rounded surfaces as illustrated in FIG. 5. In the exemplary embodiment of FIG. 5, lock surface 57 is planar, but other suitable shapes may be provided. If container lug 27 includes ramped or curved leading edges 31, or if locking teeth 49 include ramped surfaces 59 (or both), then locking teeth 49 will tend to ride over container lugs 27 as closure 40 is applied to container 20.

Once closure 40 is applied to container 20, container lugs 27 and locking teeth 49 will engage one another to form a child-resistant position of container 20 and closure 40. In this position, container locking surfaces 33 and closure lock surfaces 57 cooperate to prevent rotation of closure 40 in an opening direction. The provision of a plurality of locking teeth 49 in each set allows for engagement between locking teeth 49 and container lugs 27 over a relatively substantial rotational range, compared to the range allowed by a single locking tooth 49 on each side of outer skirt 47. This arrangement allows significant manufacturing tolerances in the formation of the container lugs 27, locking teeth 49, and threads 23 and 45.

In order to remove closure 40 from container 20, a user should deform outer skirt 47, for example by squeezing outer skirt 47 at points roughly half way between the two sets of locking teeth 49, as shown by the arrows in FIG. 4. This deformation of outer skirt 47 causes locking teeth 49 to move radially outwardly. In this position, locking teeth 49 are disengaged from container lugs 27, and closure 40 may be rotated in an opening direction to remove closure 40 from container 20 by disengaging, for example, threads 23 and 45. Indicia such as, for example, vertical ribs or smoothed regions may be provided on the outer surface of outer skirt 47 (or on container 20) to indicate to the user where outer skirt 47 should be squeezed.

In a preferred embodiment of a closure 40 according to the present invention, outer skirt 47 includes at least one thinned-out region 53, i.e., a region of outer skirt 47 that is of lesser thickness than the remainder of outer skirt 47. Preferably two thinned-out regions 53 are provided. Each thinned-out region 53 is disposed, for example, so that at least one locking tooth 49 of a corresponding set of locking teeth 49 is disposed on thinned-out region 53. Thinned-out region 53 facilitates deformation of outer skirt 47, reducing the amount of force required to disengage locking teeth 49 and container lugs 27, and thereby remove closure 40 from container 20.

FIG. 5 illustrates the axially offset arrangement of locking teeth 49 on a closure 40 according to the present invention. It is understood that the term "axially offset" refers to the bottom edges 55 of locking teeth 49, i.e., that the distances between bottom edges 55*a* to 55*d* of each locking tooth 49 and the skirt edge 51 of outer skirt 47 become greater or smaller. In particular, locking teeth 49 are preferably disposed at axially higher positions along outer skirt 47 as one moves from a trailing tooth 49*d* of the set to a leading tooth 49*a* of the set (where "trailing tooth" and "leading tooth" are defined according to movement of locking teeth 49 when closure 40 is rotated in an opening direction).

When locking teeth 49 within a set of teeth 49 are offset so that leading locking tooth 49*a* of a set is "higher" on the closure than trailing tooth 49*d* of the set, then leading tooth 49*a* is less likely to interfere with a container lug 27 on the opposite side of container 20 as closure 40 is rotated off container 20. This minimizes the possibility that users will need to deform closure 40 through an unduly great angle of rotation, or perform two separate deformations of closure 40, in order to remove closure 40 from container 20. In addition, the provision of axially offset locking teeth 49 may require less material, decreasing manufacturing costs.

The exemplary set of locking teeth 49 illustrated in FIG. 5 are offset from one another in a substantially helical configuration. In this arrangement, the distances between locking teeth bottom edges 55*a* to 55*d* and skirt edge 51 increase roughly linearly as one moves from trailing tooth 49*d* to leading tooth 49*a*. It is understood that other arrangements are included within the term "axially offset." For example, only the leading locking tooth 49*a* of a set might be axially offset from other locking teeth 49. Alternatively, for example, two leading locking teeth 49 in a set of four teeth 49 may be axially offset from two trailing locking teeth 49.

The closure and container according to the present invention have been described with respect to several exemplary embodiments. It can be understood, however, that there are other variations of the above-described embodiments which will be apparent to those skilled in the art, even where elements have not explicitly been designated as exemplary. For example, closure 40 may include one or more annular sealing rings or liners that depend from top wall 41, which may cooperate with neck 21 to form a sealing arrangement. In addition, closure 40 may include a tamper indicating mechanism to indicate to a consumer whether the container has been opened. It is understood that these and other modifications are within the teaching of the present invention, which is to be defined by the claims appended hereto.

What is claimed is:

1. A child resistant closure, comprising:

a top wall;

a skirt depending from the top wall;

a set of locking teeth disposed on an inner surface of the skirt, the locking teeth being arranged circumferentially around a portion of the inner surface and the locking teeth in the set being axially offset and radially spaced apart from one another;

wherein the skirt includes a thinned-out region relative to a region adjacent the set of locking teeth, at least one of the locking teeth being disposed on the thinned-out region.

2. The child resistant closure according to claim 1, wherein the locking teeth are arranged in a substantially helical pattern around the portion of the inner surface.

3. A child resistant closure, comprising:

a top wall;

an inner skirt depending from the top wall, the inner skirt including an internal thread;

an outer skirt depending from the top wall, the outer skirt including an inner surface; and at least one set of locking teeth disposed on the inner surface of the outer skirt, the locking teeth in each set being arranged circumferentially around a first portion of the inner surface, and the locking teeth in each set axially offset and radially spaced apart from one another;

wherein the outer skirt includes a thinned-out region relative to a region adjacent the set of locking teeth, at least one of the locking teeth being disposed on the thinned-out region.

4. The child resistant closure according to claim 3, wherein the locking teeth are arranged in a substantially helical pattern around the inner surface.

5. The child resistant closure according to claim 3, further comprising a second set of locking teeth being arranged circumferentially around a second portion of the inner surface, and locking teeth in the second set being axially offset from one another.

6. The child resistant closure according to claim 5, wherein the first set of locking teeth are arranged in a first substantially helical pattern around the first portion of the inner surface, and the second set of locking teeth are arranged in a second substantially helical pattern around the second portion of the inner surface.

7. The child resistant closure according to claim 5, wherein the skirt further includes a second thinned-out region, at least one of the second set of locking teeth being disposed oh the second thinned out region.

8. A child resistant closure and container, comprising:

a container including a neck having a container engagement mechanism, the container including at least one container lug; and a closure, including:

a top wall;

an inner skirt depending from the top wall, the inner skirt including a closure engagement mechanism, the closure engagement mechanism cooperating with the container mechanism;

an outer skirt depending from the top wall, the outer skirt including an inner surface; and at least one set of locking teeth disposed on the inner surface of the outer skirt, each set of locking teeth being arranged circumferentially around a portion the inner surface, and the locking teeth in each set being axially offset and radially spaced apart from one another, each set of locking teeth corresponding to a respective one of the at least one container lug;

wherein when the closure in a closed position one of the locking teeth engages the respective container lug.

9. The closure and container according to claim 8, wherein removal of the closure requires deformation of the outer skirt and rotation of the closure, so that each of the locking teeth in the set clears the container lug.

10. The closure and container according to claim 8, wherein the outer skirt includes a thinned-out region, at least one of the locking teeth being disposed on the thinned-out region.

11. The closure and container according to claim 8, wherein the set of locking teeth are arranged in a substantially helical pattern around the portion of the inner surface.

12. The closure and container according to claim 8, wherein the inner skirt is substantially annular and the outer skirt is substantially frusto-conical.

13. The closure and container according to claim 8, wherein the container includes two container lugs;

wherein the closure includes a second set of locking teeth arranged circumferentially around a second portion of the inner surface, the locking teeth in the second set being axially offset from one another; and wherein when the closure in a closed position a locking tooth in the first set engages a first one of the two container lugs, and a locking tooth in the second set engages a second one of the two container lugs.

14. The closure and container according to claim 13, wherein removal of the closure requires deformation of the outer skirt and rotation of the closure, so that each of the first set of locking teeth clears the first one of the two container lugs and each of the second set of locking teeth clears the second one of the two container lugs.

15. The closure and container according to claim 13, wherein the first set of locking teeth are arranged in a first substantially helical pattern around the first portion of the inner surface, and the second set of locking teeth are arranged in a second substantially helical pattern around the second portion of the inner surface.

16. The closure and container according to claim 13, wherein the outer skirt includes a first thinned-out region, at least one of the first set of locking teeth being disposed on the first thinned-out region, and the outer skirt includes a second thinned-out region, at least one of the second set of locking teeth being disposed on the second thinned out region.

17. The closure and container according to claim 13, wherein the inner skirt is substantially annular and the outer skirt is substantially frusto-conical.

* * * * *

UNITED STATES PATENT AND TRADEMARK OFFICE

CERTIFICATE OF CORRECTION

PATENT NO. : 6,640,987 B2
DATED : November 4, 2003
INVENTOR(S) : John A. Vassallo It is certified that error appears in the above-identified patent and that said Letters Patent is hereby corrected as shown below:

Column 5,
Line 54, change “disposed oh” to -- disposed on --.

Signed and Sealed this

Thirteenth Day of July, 2004

JON W. DUDAS
*Acting Director of the United States Patent and Trademark Office*